US011365864B2

(12) United States Patent
Kim et al.

(10) Patent No.: US 11,365,864 B2
(45) Date of Patent: Jun. 21, 2022

(54) REAR LAMP HAVING MOVING INFINITY MIRROR EFFECT

(71) Applicant: Korea Photonics Technology Institute, Gwangju (KR)

(72) Inventors: Sang-Yoo Kim, Gwangju (KR); Kwang-Woo Park, Anseong-si (KR); Jong-Guck Kim, Gwangju (KR); Su-Bin No, Gwangju (KR)

(73) Assignee: Korea Photonics Technology Institute, Gwangju (KR)

( * ) Notice: Subject to any disclaimer, the term of this patent is extended or adjusted under 35 U.S.C. 154(b) by 0 days.

(21) Appl. No.: 17/290,008

(22) PCT Filed: Dec. 28, 2018

(86) PCT No.: PCT/KR2018/016808
§ 371 (c)(1),
(2) Date: Apr. 29, 2021

(87) PCT Pub. No.: WO2020/138555
PCT Pub. Date: Jul. 2, 2020

(65) Prior Publication Data

US 2022/0003382 A1 Jan. 6, 2022

(30) Foreign Application Priority Data

Dec. 27, 2018 (KR) ..... 10-2018-0170750

(51) Int. Cl.

| | |
|---|---|
| ***F21S 43/50*** | (2018.01) |
| ***F21S 43/37*** | (2018.01) |
| ***F21S 43/20*** | (2018.01) |
| ***F21V 3/04*** | (2018.01) |
| ***F21V 14/04*** | (2006.01) |

(52) U.S. Cl.
CPC ..... *F21S 43/50* (2018.01); *F21S 43/26* (2018.01); *F21S 43/37* (2018.01); *F21V 3/04* (2013.01); *F21V 14/04* (2013.01)

(58) Field of Classification Search
CPC .. F21S 43/50; F21S 43/37; F21V 3/04; F21V 14/04
See application file for complete search history.

(56) References Cited

U.S. PATENT DOCUMENTS

| | | | |
|---|---|---|---|
| 2006/0284788 A1 | 12/2006 | Robinson et al. | |
| 2009/0154184 A1 | 6/2009 | King et al. | |

FOREIGN PATENT DOCUMENTS

| | | | | |
|---|---|---|---|---|
| CN | 202403140 U | * | 8/2012 | ..... B60Q 1/2692 |
| CN | 113310024 A | * | 8/2021 | |
| JP | 2011-28961 A | | 2/2011 | |
| KR | 10-0822548 B1 | | 4/2008 | |
| KR | 10-2016-0091867 A | | 8/2016 | |

OTHER PUBLICATIONS

International Search Report dated Sep. 24, 2019 in counterpart International Patent Application No. PCT/KR2018/016808 (2 pages in Korean and 2 pages in English).
Written Opinion dated Sep. 24, 2019 in counterpart International Patent Application No. PCT/KR2018/016808 (4 pages in Korean).

* cited by examiner

*Primary Examiner* — Anabel Ton
(74) *Attorney, Agent, or Firm* — NSIP Law

(57) ABSTRACT

The present invention relates to a rear lamp which has a 3D light distribution effect so as to represent a sense of depth by the infinity mirror effect and, more specifically, to a rear lamp configured to produce a movable light distribution image.

5 Claims, 8 Drawing Sheets

REAR LAMP HAVING MOVING INFINITY MIRROR EFFECT

CROSS REFERENCE TO RELATED APPLICATIONS

This application is a U.S. National Stage Application of International Application No. PCT/KR2018/016808, filed on Dec. 28, 2018, which claims the benefit under 35 USC 119(a) and 365(b) of Korean Patent Application No. 10-2018-0170750, filed on Dec. 27, 2018, in the Korean Intellectual Property Office, the entire disclosure of which is incorporated herein by reference for all purposes.

TECHNICAL FIELD

The present disclosure relates to a rear lamp which has a 3D light distribution effect so as to represent a sense of depth by the infinity mirror effect and, more specifically, to a rear lamp configured to produce a movable light distribution image.

BACKGROUND ART

In general, vehicles are equipped with various lighting devices at the front and rear to provide vehicle safety and driving convenience. Such lighting devices include devices that directly emit light using lamps, such as headlights, taillights, and turn indicators. In addition, the vehicles are equipped with a reflectors at the front and rear to perform a function of reflecting light such that the vehicles can be easily recognized from the outside.

In recent years, various types of lighting devices have been developed within the scope of complying with the minimum legal regulations in accordance with the trend of focusing on vehicle design. In particular, light guide devices that enable an indirect lighting effect to be exerted without direct exposure of a light source for emitting light have been actively installed in vehicles in recent years.

As illustrated in FIG. 1, a conventional vehicle rear lamp includes a housing 28 having a reflector 26 mounted on the front side thereof, a bulb 24 mounted on the front central portion of the reflector 26, a shield 32 disposed in front of the bulb 24 so as to be spaced apart from the bulb 24 and the bulb 24 so as to block heat, and a lens 30 coupled to the peripheral edge of the housing 28.

In such a conventional rear lamp, when light emitted from the bulb 24, which is a light source, is reflected by the reflector 26, the reflected light is radiated to the rear side of the vehicle through the shield 2 and the lens 30.

However, since the conventional rear lamp simply emits light and reflects using the bulb 24 and the reflector 26, the design has been inevitably standardized, and when the number of bulbs 24 installed to increase the luminous effect is increased, there is a problem in that the cost and weight are increased, lowering the marketability.

A rear lamp including a light transmission unit 14 and a reflector 13, which are spaced apart from each other by a predetermined distance, as illustrated in FIG. 2, has been actively developed in recently years. When light emitted from an LED 12 is reflected from the reflector 13, the light transmission unit 14 transmits some of the light reflected from the reflector 13 and reflects the remaining light to the reflector 13, thereby producing an infinity mirror effect that causes a sense of depth to be felt in a 3D manner, as illustrated in FIG. 3.

However, the conventional rear lamp has a problem in that the LED 12 is clearly exposed in a dot shape, as illustrated in FIG. 4, and thus the aesthetic feeling is deteriorated due to the exposure of a PCB.

In addition, since distributed light images are distributed as static light images without motion, there is a problem in that only a limited type of design can be expressed.

DETAILED DESCRIPTION OF THE INVENTION

Technical Problem

The present disclosure has been conceived in order to solve the problems described above. The present disclosure provides a rear lamp capable of smoothly distributing a clean light image such that a PCB and an LED are not visible in the light image and capable of distributing light images of various designs by making it possible to move a distributed light image.

Technical Solution

In view of the foregoing, a rear lamp according to the present disclosure includes: a light source unit 102 configured to output light; a lens unit 110 configured to output, as parallel light, light incident thereon after output from the light source unit 101; a light transmission unit 130 installed in a path of light emitted from the lens unit 110, the light transmission unit 30 being configured to transmit some of light incident thereon and to reflect the remaining light; a reflector 120 installed in a path of light reflected from the light transmission unit 130 so as to reflect light incident thereon back to the light transmission unit 130; and a reflector driving unit configured to drive the reflector 120 so as to change an angle formed by the reflector 120 with the light transmission unit 130.

In this case, the lens unit 110 is a collimator lens including an incident unit 111 on which the light output from the light source unit 102 is incident, and an emission unit 114 through which light incident on the incident unit 111 is emitted to the light transmission unit 130.

In addition, the rear lamp further includes a diffusion unit 112 configured to scatter and diffuse the light emitted from the emission unit 114 so as to allow the light to be incident on the light transmission unit 130.

In addition, the reflector 120 has a reflective surface 121 formed as a spherical or aspherical surface having an arbitrary curvature.

In addition, the lens unit 110 further includes an auxiliary emission unit 115 configured to output some of the light incident on the incident unit 111 as a light distribution pattern, rather than emitting the some of the light to the light transmitting unit 130.

In addition, the rear lamp further includes a microlens array 150 configured to output the light emitted from the auxiliary emission unit 115 as a predetermined light distribution pattern.

In addition, the rear lamp further includes a stopper 117 configured to limit an angular displacement amount of the reflector 120 obtained using the reflector driving unit.

Advantageous Effects

According to the present disclosure configured as described above, it is possible to distribute a clean light image by smoothly distributing the light image such that a PCB and an LED are not visible in the light image to be distributed.

In addition, it is possible to obtain light images of various designs since it is possible to move a distributed light image by tilting the reflector 120 by driving an actuator.

DESCRIPTION OF REFERENCE NUMERALS OF MAIN COMPONENTS IN DRAWINGS

Figure 1:
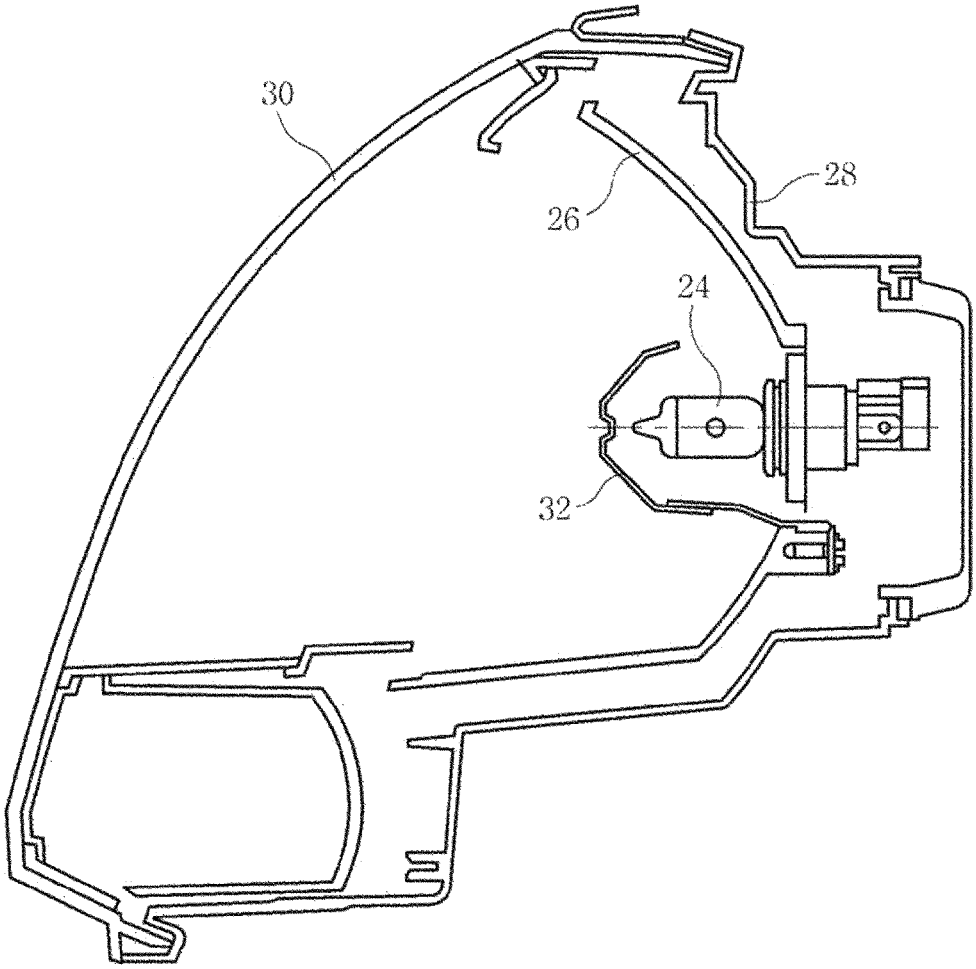
FIG. 1 is a cross-sectional view illustrating a structure of a conventional vehicle rear lamp.
Figure 2:
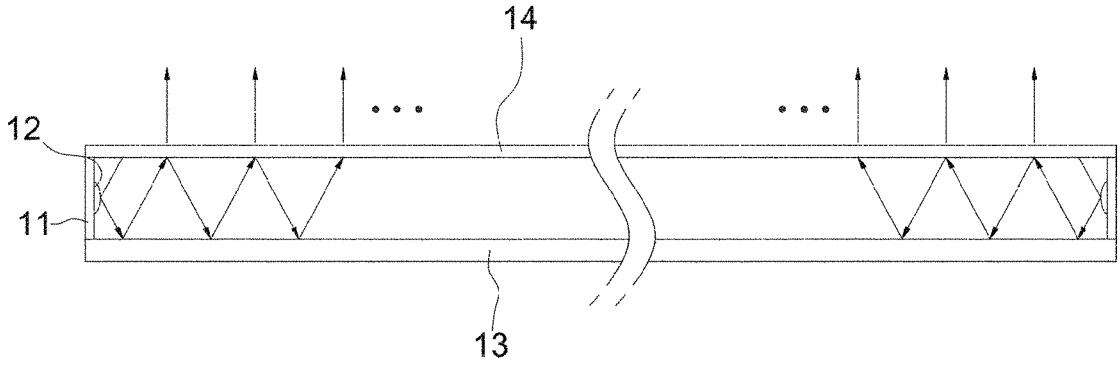
FIG. 2 is a view illustrating a structure of a conventional rear lamp having an infinity mirror effect.
Figure 3:
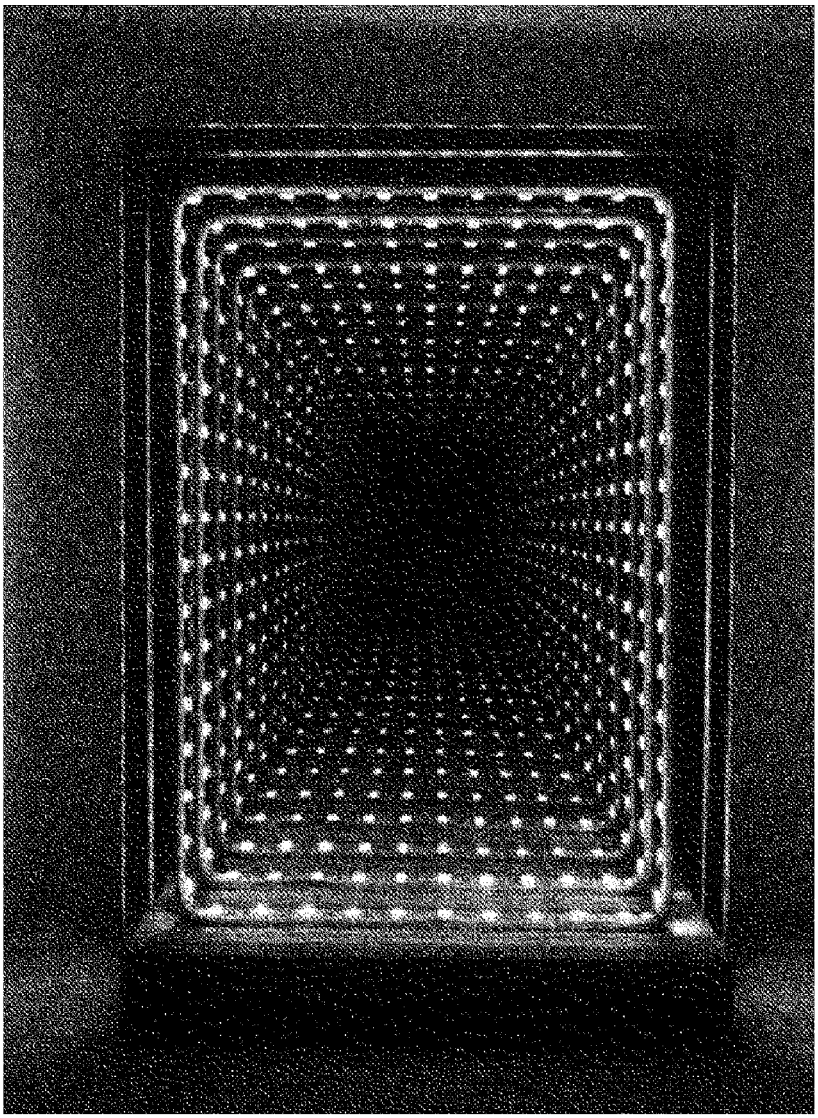
FIGS. 3 and 4 are photographs of light images distributed by a rear lamp having a conventional infinity mirror effect.
Figure 4:
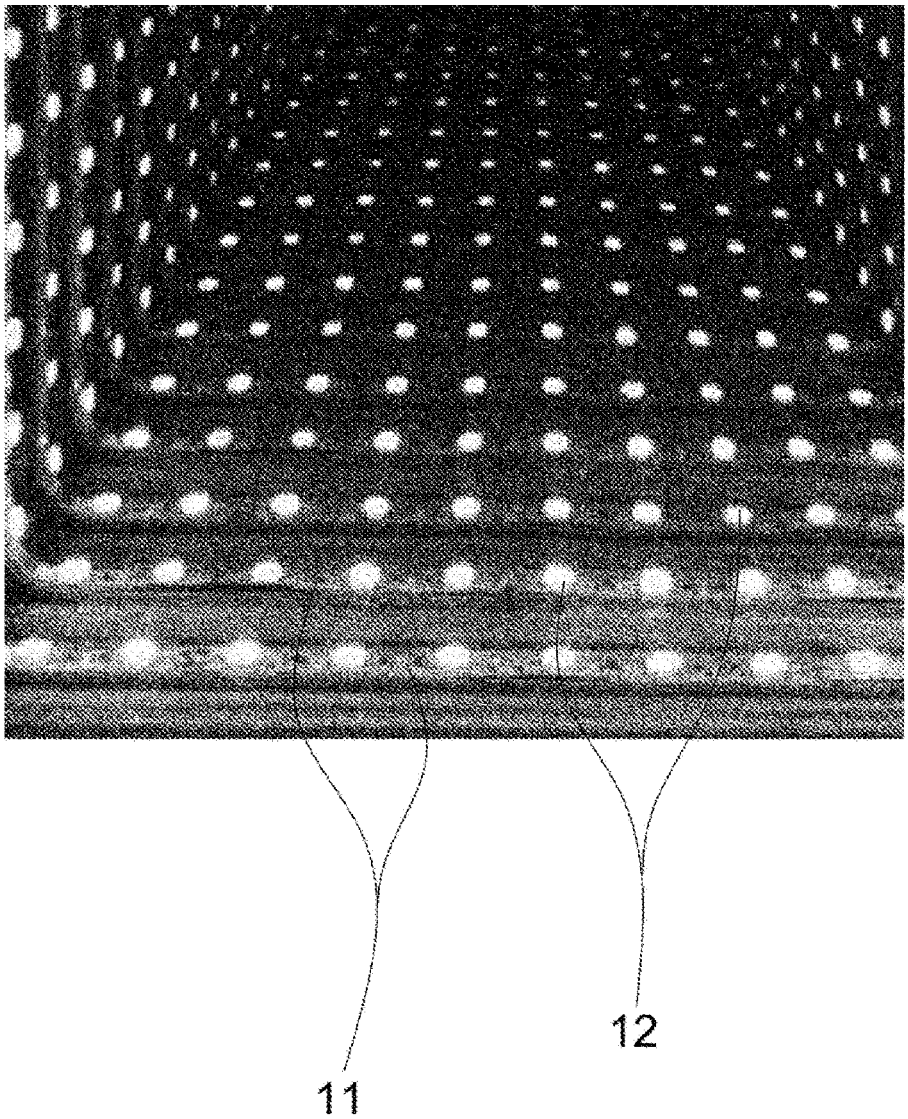

101: PCB, 102: light source unit
103: structure, 110: lens unit
111: incident unit, 112: diffusion unit
113: total reflection unit, 114: emission unit
115: auxiliary emission unit, 116: microlens array
117: stopper, 120: reflector
121: reflective surface, 130: light transmission unit
$I_s$: stationary light image, $I_1$: $1^{st}$ light image
$I_2$: $2^{nd}$ light image, $I_3$: $3^{rd}$ light image
$I_4$: $4^{th}$ light image

MODE FOR CARRYING OUT THE INVENTION

Hereinafter, the present disclosure will be described in detail with reference to embodiments of the present disclosure and the accompanying drawings, but it will be described on the premise that the same reference numerals refer to the same elements.

In the detailed description of the present disclosure or in the claims, when it is described that one component "includes" another component, it shall not be limitedly construed as consisting of only the component unless otherwise stated, and shall be understood that other components may be further included.

The rear lamp according to the present disclosure includes a light source unit 102, a lens unit 110, a light transmission unit 130, a reflector 140, a reflector driving unit, and a housing (not illustrated) configured to accommodate these components.

Figure 5:
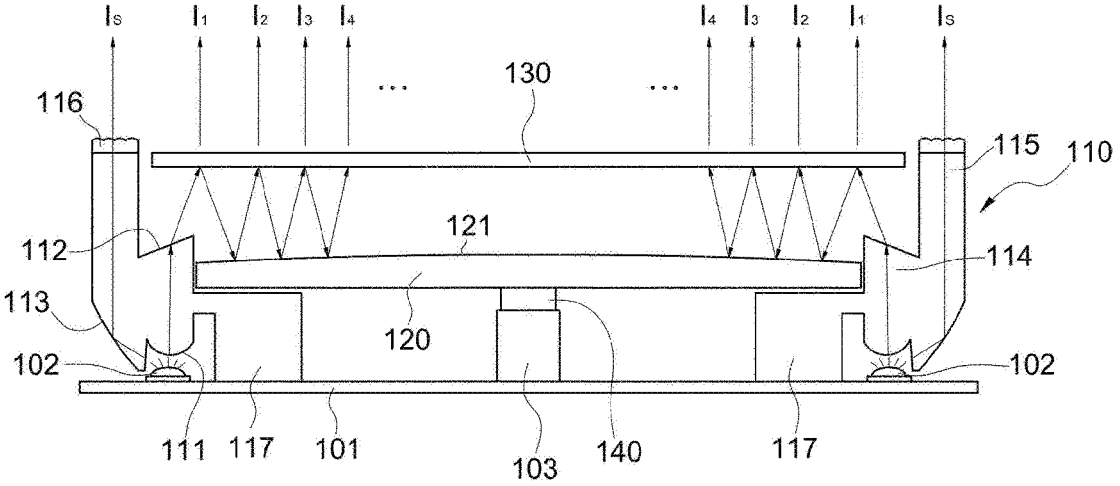
FIG. 5 is a cross-sectional view illustrating an internal state of the rear lamp in the state in which an actuator is not driven.

The lens unit 110 is a component configured to convert incident light output from the light source unit 102 into parallel light and output the parallel light, and is formed of a material such as PMMA or PC. As illustrated in FIG. 5, the lens unit 110 includes an incident unit 111 on which light output from the light source unit 102 is incident, and an emission unit 114 configured to convert the light incident from the incident unit 111 into parallel light and emit the parallel light to the light transmission unit 130. Preferably, the lens unit is configured as a total reflection lens or a collimator lens.

The emission unit 114 forms a light path such that the light output from the light source unit 102 is capable of moving to the light transmission unit 130 and the reflector 120 in order to form a 3D light distribution pattern having a 3D sense of depth.

It is preferable to form the diffusion unit 112 on the surface of the emission unit 114 such that light emitted from the emission unit 114 is scattered from the diffusion unit 112 so as to be incident on the light transmission unit 130.

The diffusion unit 112 makes it possible to achieve uniform light emission by irregularly reflecting and scattering the parallel light output from the emission unit 114.

When the diffusion unit 112 is not present, the light output from the light source unit 102 is incident on the light transmission unit 130 as it is. Thus, the shape of the light source is exposed as it is, and it is impossible to achieve uniform light emission.

In addition, as illustrated in FIG. 5, it is preferable to further include an auxiliary emission unit 115 configured to form parallel light in a path different from that formed by the emission unit 114 so as to emit the light incident on the incident unit 111 of the lens unit 110 through the path.

That is, as illustrated in FIG. 5, some of the light incident on the incident unit 111 is emitted to the light transmission unit 130 through the diffusion unit 112, and the remaining light incident on the incident unit 111 is emitted in the form of parallel light through the auxiliary emission unit 115.

In this case, it is preferable to configure a microlens array 116 on the surface of the auxiliary emission unit 115. The microlens array 116 causes the light emitted from the auxiliary emission unit 115 to be incident thereon so as to be output as a light image of a predetermined light distribution pattern, that is, a rectilinear pattern.

As illustrated in FIG. 5, the light transmission unit 130 is formed in a plate shape, and is installed on a moving path of light passing through the lens unit 110. The light transmission unit 130 is configured to transmit some of the light incident from the lens unit 110 and some of the light incident from the reflector 120 and to reflect the remaining light to the reflector 120. Preferably, the light transmission unit 130 is configured as a beam splitter.

As described above, the light transmission unit 130 is configured to transmit some of the incident light and reflect the remaining light, and may be installed by selecting a transmittance.

For example, the light transmission unit 130 may be configured with various transmittances so as to transmit, for example, 70% and reflect 30% or so as to transmit 50% and to reflect 50%.

The reflector 110 is formed in a plate shape, is installed on a path through which the light reflected from the light transmission unit 130 moves, and is configured to reflect the light, reflected from the light transmission unit 130, back to the light transmission unit 130.

In addition, the reflective surface 121 on the surface of the reflector 120 may be made of a spherical or aspherical surface having a predetermined curvature, and the reflective surface 121 of the reflector may be made in a convex shape having different horizontal and vertical curvatures.

That is, the convex shape of the reflective surface 121 of the reflector forms different angles with the light transmission unit 130, whereby it is possible to adjust the angles such that the widths (thicknesses) of light images $I_1$, $I_2$, $I_3$, $I_4$, . . . passing through the light transmission unit 130 are formed to be different from each other.

The multiple light images formed to have different widths in this way form a light distribution pattern that enables a 3D effect to be felt, so that a 3D sense of depth can be felt.

In addition, a reflector driving unit is configured to tilt the reflector 120.

The reflector driving unit is configured to tilt the reflector 110 so as to change the reflection angle at which the light incident on the reflector 110 is reflected to the light transmission unit 130, thereby changing the light distribution pattern formed by light passing through the light transmitting unit 130.

The reflector driving unit is configured to tilt the reflector 120 by driving an actuator 140 installed in at center of the reflector 120, as illustrated in FIG. 5.

Alternatively, although not illustrated in the drawings, it is also possible to change the reflection angle at which light is reflected to the light transmission unit 130 by installing, at one side of the reflector 120, an actuator driven to move up and down.

An operation process of the rear lamp of the present disclosure configured as described above will be described.

Light output from the light source unit 102 is totally reflected through the incidence unit 111 to be converted into parallel light, and the parallel light is emitted through the emission unit 114 and scattered through the diffusion unit 112 on the surface of the emission unit 114. Thus, uniform light is emitted.

The emitted light is incident on the light transmission unit 130 so that some of the light is transmitted so as to form a $1^{st}$ light image $I_1$, and the remaining light is reflected to the reflector 120.

The light incident on the reflector 120 is reflected back to the light transmission unit 130. Some of the light incident on the light transmission unit 130 passes through the light transmission unit 130 so as to form a 2 light image 12, and the remaining light is reflected back to the reflector 120.

The light incident on the reflector 120 is reflected back to the light transmission unit 130. Some of the light incident on the light transmission unit 130 passes through the light transmission unit 130 so as to form a $3^{rd}$ light image $I_3$, and the remaining light is reflected back to the reflector 120.

In this way, a $4^{th}$ light image $I_4$ is formed, and light images are successively formed.

Some of the light output from the light source unit 102 is incident on the total reflection unit 113 and reflected as shown in FIG. 5, thereby being emitted to the auxiliary emission unit 115 and emitted through the microlens array 116 formed on the surface of the auxiliary emission unit 115, thereby forming a stationary light image $I_s$.

The microlens array 116 causes the light incident thereon after emitted from the auxiliary emission unit 115 to be output as a light image of a predetermined light distribution pattern, that is, a rectilinear pattern.

Figure 6:
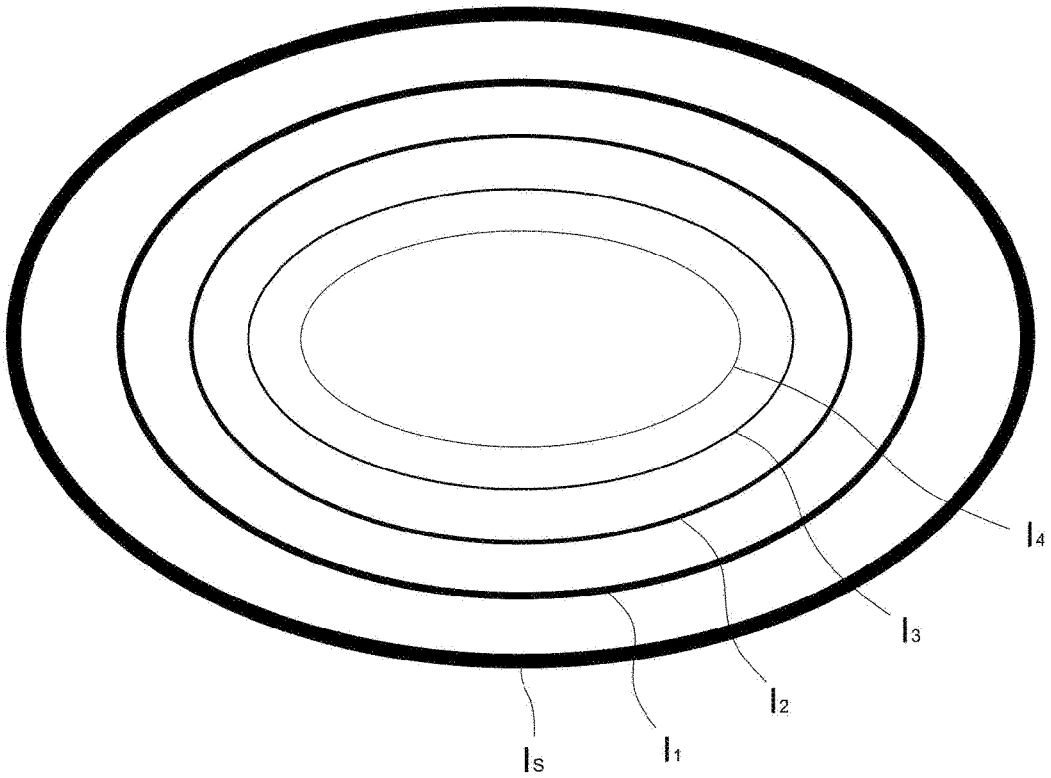
FIG. 6 is a view illustrating a light distribution pattern of the rear lamp in the state in which the actuator is not driven.

In FIG. 5, because the incident angle and reflection angle between the light transmission unit 130 and the reflector 120 on opposite sides with respect to the reflector 120 are the same, a light distribution pattern is shown as illustrated in FIG. 6.

Figure 7:
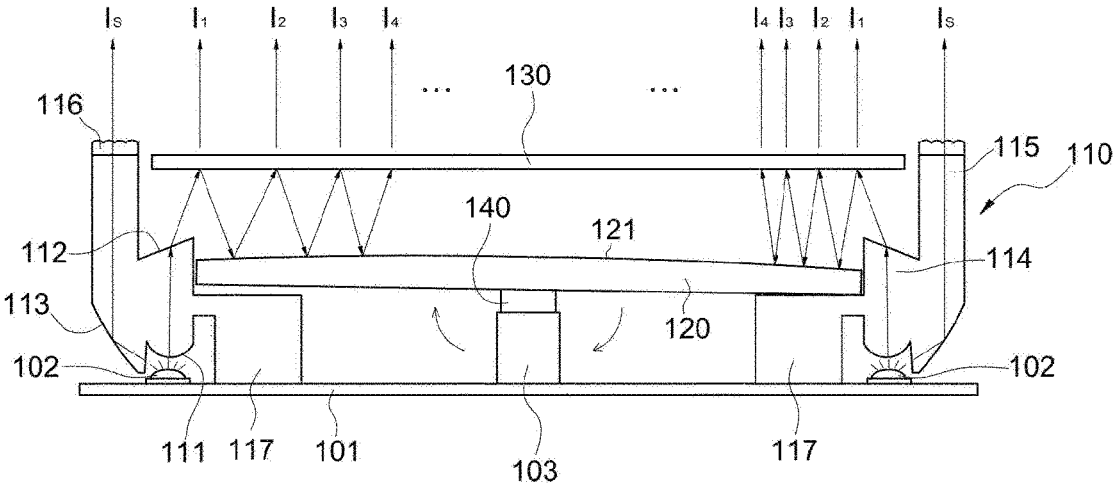
FIG. 7 is a cross-sectional view illustrating the state in which a reflector is tilted to one side by driving the actuator.
Figure 8:
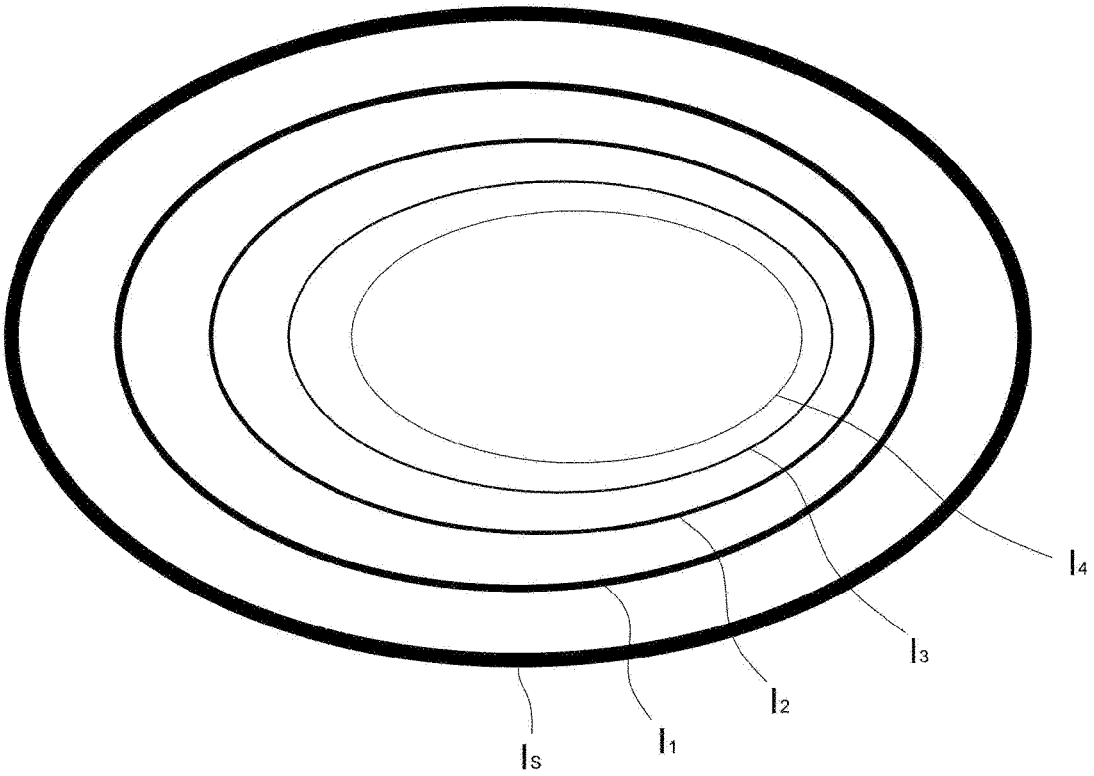
FIG. 8 is a view illustrating a light distribution pattern in the state in which the reflector is tilted to one side by driving the actuator.

When the actuator 140 is driven and the reflector 120 is tilted clockwise as illustrated in FIG. 7, the incident angle and reflection angle of light between the reflector 120 and the light transmission unit 130 in the direction in which the reflector is inclined, namely, at the right side of the figure is decreased, and the incident angle and reflection angle of light between the reflector 120 and the light transmission unit 130 at the left side of the figure is increased. Thus, a light distribution pattern is shown as illustrated in FIG. 8.

Figure 9:
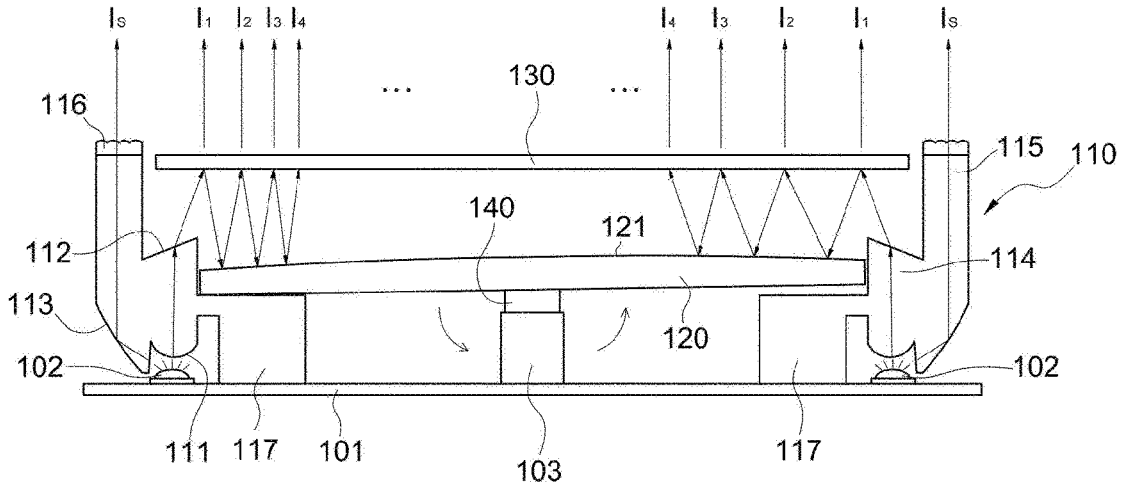
FIG. 9 is a cross-sectional view illustrating the state in which the reflector is tilted to the other side by driving the actuator.
Figure 10:
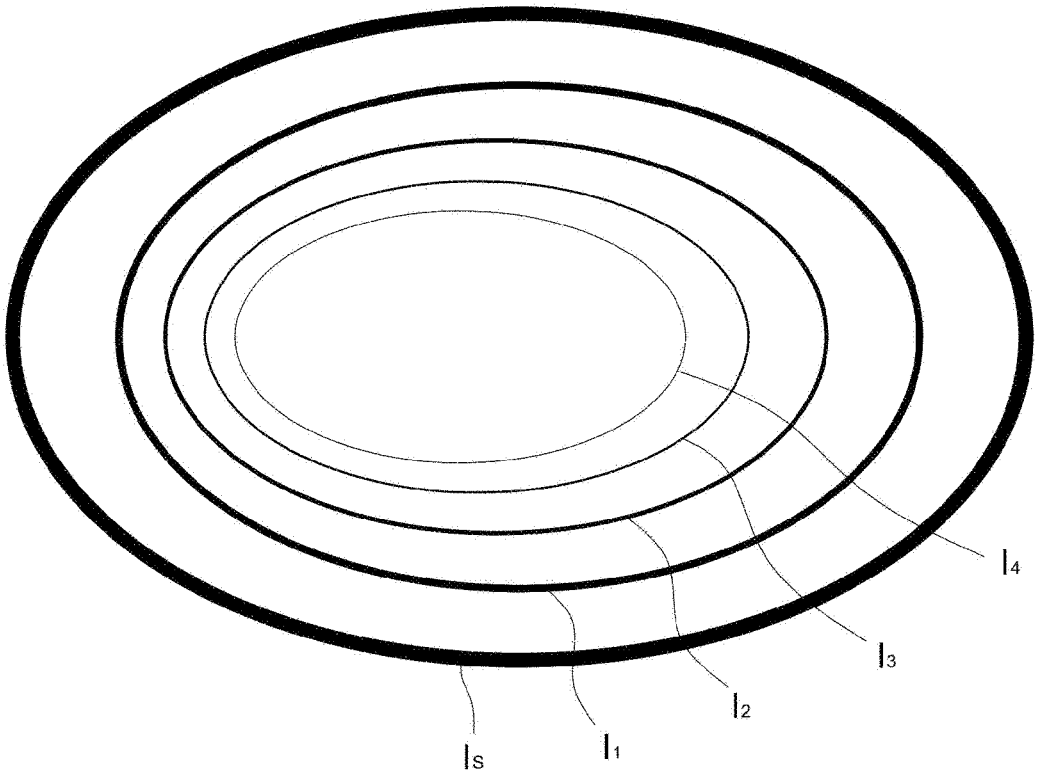
FIG. 10 is a view illustrating a light distribution pattern in the state in which the reflector is tilted to the other side by driving the actuator.

When the actuator 140 is driven and the reflector 120 is tilted counterclockwise as illustrated in FIG. 9, the incident angle and reflection angle of light between the reflector 120 and the light transmission unit 130 in the direction in which the reflector is inclined, namely, at the left side of the figure, is decreased, and the incident angle and reflection angle of light between the reflector 120 and the light transmission unit 130 at the right side of the figure is increased. Thus, a light distribution pattern is shown as illustrated in FIG. 10.

That is, when the actuator is driven in the state in which the rear lamp is turned on, the $1^{st}$ to $4^{th}$ light images $I_1$, to $I_4$ of the light distribution patterns move in the direction in which the reflector 120 is inclined, and thus form a dynamic light distribution pattern.

In addition, it is preferable to limit the rotational angular displacement so that the reflector 120 does not rotate excessively by configuring a stopper 117 under the reflector 120 as illustrated in FIG. 5.

At this time, the stationary light image $I_s$ located at the outermost side of the light distribution pattern does not move even when the actuator 140 is driven.

The stationary light image $I_s$ is not a light image formed by the light transmitting part 130, but a light image formed through the auxiliary emission unit 115 of the lens part 110 without passing through the light transmitting part 130. The stationary light image $I_s$ does not move.

In the above-described embodiments, it has been described that the actuator 140 is installed in the center of the reflector 120 such that the actuator tilts the reflector 120 in a roll or pitch direction from the center, but the actuator 140 may be configured in a different form.

Figure 11:
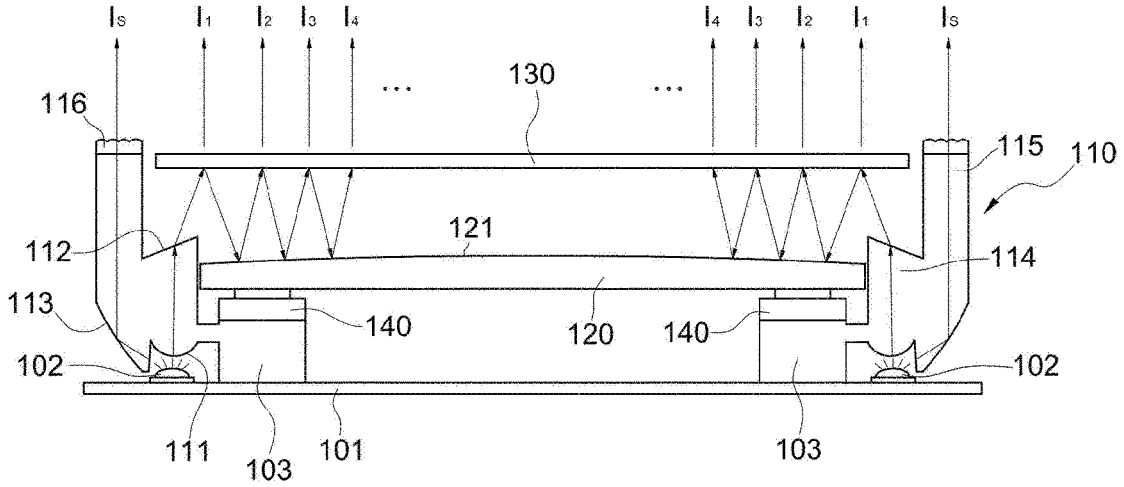
FIG. 11 is a view illustrating a configuration of another type of actuator.

As illustrated in FIG. 11, by installing two or three lifting-type actuators 140 at the edge of the reflector 120, the actuators 140 tilt the reflector 120 while being raised and lowered in the z-axis direction.

According to the present disclosure configured as described above, it is possible to distribute a clean light image by smoothly distributing the light image such that a PCB and an LED are not visible in the light image to be distributed.

In addition, it is possible to obtain light images of various designs since it is possible to move a distributed light image by tilting the reflector 120 by driving an actuator.

The technical idea of the present disclosure has been discussed based on the embodiments described above.

It is apparent that a person ordinarily skilled in the art to which the present disclosure belongs can variously modify or change the above-described embodiments based on the description of the present disclosure.

In addition, it is evident that, even if not explicitly shown or described, a person ordinarily skilled in art the to which the present disclosure belongs can make various modifications including the technical idea according to the present disclosure based on the description of the present disclosure, and the modifications still fall into the scope of the present disclosure.

The embodiments described above with reference to the accompanying drawings have been described for the purpose of describing the present disclosure, and the scope of the present disclosure is not limited to these embodiments.

The invention claimed is:

1. A rear lamp having a moving infinity mirror effect, the rear lamp comprising:

a light source unit (102) configured to output light;

a lens unit (110) being a collimator lens, and comprising an incident unit (111) on which the light output from the light source unit (102) is incident, and an emission unit (114) through which light incident on the incident unit (111) is emitted to a light transmission unit (130);

a diffusion unit (112) configured to scatter and diffuse the light emitted from the emission unit (114) so as to allow the light to be incident on the light transmission unit (130);

the light transmission unit (130) being installed in a path of light emitted from the diffusion unit (112), the light transmission unit (130) being configured to transmit some of light incident thereon and to reflect remaining light;

a reflector (120) installed in a path of light reflected from the light transmission unit (130) so as to reflect light incident thereon back to the light transmission unit (130); and a reflector driving unit configured to drive the reflector (120) so as to change an angle formed by the reflector (120) with the light transmission unit (130).

2. The rear lamp of claim 1, wherein the reflector (120) has a reflective surface (121) formed as a spherical or aspherical surface having an arbitrary curvature.

3. The rear lamp of claim 1, wherein the lens unit (110) further comprises an auxiliary emission unit (115) configured to output some of the light incident on the incident unit (111) as a light distribution pattern, rather than emitting the some of the light to the light transmitting unit (130).

4. The rear lamp of claim 3, further comprising:

a microlens array (150) configured to output the light emitted from the auxiliary emission unit (115) as a predetermined light distribution pattern.

5. The rear lamp of claim 1, further comprising:

a stopper (117) configured to limit an angular displacement amount of the reflector (120) obtained using the reflector driving unit.

* * * * *